US010016052B2

(12) United States Patent
McStay

(10) Patent No.: US 10,016,052 B2
(45) Date of Patent: Jul. 10, 2018

(54) HOLSTER FOR HAIR STYLING SHEARS

(71) Applicant: Monica McStay, Killeen, TX (US)

(72) Inventor: Monica McStay, Killeen, TX (US)

( * ) Notice: Subject to any disclaimer, the term of this patent is extended or adjusted under 35 U.S.C. 154(b) by 0 days.

(21) Appl. No.: 15/481,198

(22) Filed: Apr. 6, 2017

(65) Prior Publication Data

US 2017/0265635 A1 Sep. 21, 2017

Related U.S. Application Data

(63) Continuation of application No. 13/403,774, filed on Feb. 23, 2012.

(51) Int. Cl.
*A45F 5/02* (2006.01)
*A45F 3/02* (2006.01)

(52) U.S. Cl.
CPC ..... *A45F 5/021* (2013.01); *A45F 3/02* (2013.01); *A45F 2200/0575* (2013.01); *Y10T 29/49817* (2015.01)

(58) Field of Classification Search
CPC .... A45F 5/021; A45F 2200/0575; A45F 3/02; A45C 13/1069
USPC ..... 224/183, 236–237, 240, 904, 655, 241; 24/303
See application file for complete search history.

(56) References Cited

U.S. PATENT DOCUMENTS

D378,633 S * 4/1997 Granito ..... D3/228
6,049,914 A * 4/2000 Heilman ..... A41D 13/0012 2/247
2005/0040194 A1* 2/2005 Frye ..... A45D 29/20 224/219
2008/0149679 A1* 6/2008 Case ..... A45F 5/00 224/666

* cited by examiner

*Primary Examiner* — Scott McNurlen
(74) *Attorney, Agent, or Firm* — Meyertons, Hood, Kivlin, Kowert & Goetzel, P.C.

(57) ABSTRACT

A holster system for hair-cutting shears includes a holder and a wearable portion. The holder includes a pocket that can receive hair-cutting shears and a shears-holding portion. The shears holding portion can hold the hair cutting shears on an exterior surface of the holder. The shears-holding portion may include a magnet.

10 Claims, 3 Drawing Sheets

HOLSTER FOR HAIR STYLING SHEARS

PRIORITY CLAIM

This application is a continuation of U.S. patent application Ser. No. 13/403,774 entitled "HOLSTER FOR HAIR STYLING SHEARS", which is incorporated by reference as if fully set forth herein.

BACKGROUND

Field

The present invention relates generally to systems, devices, and methods for styling hair. More particularly, the present disclosure relates to systems and methods of holding shears or other hair styling tools while styling hair.

Description of the Related Art

Hair stylists often use a number of hair styling tools to style a client's hair. The various tools used by the stylist may be maintained on a counter or tray. In addition, some stylists keep shears or other tools in a pocket of a carrier attached to the stylist's body.

In some cases, a hair stylist may need to change tools many times during the course of a style. Also, the stylist may temporarily put down shears or other tools in order to apply water or hair spray to the client's hair. Each time a tool is put aside, the stylist must typically either reach to a tray or remove a tool from a pocket in a carrier. The cumulative effect of putting down and picking up tools may result in more time for a style for each client, and to reduced efficiency for the stylist (for example, few styles completed in given amount of time).

SUMMARY

Embodiments of systems, devices, and methods for styling hair and holding hair styling tools are described herein. In an embodiment, a holster system for hair-cutting shears includes a holder and a wearable portion. The holder includes a pocket that can receive hair-cutting shears and a shears-holding portion. The shears-holding portion can hold the hair cutting shears on an exterior surface of the holder. In some embodiments, the shears-holding portion includes a magnet that holds the shears.

In an embodiment, a device for carrying a hair-styling tool on a person includes a holder and a wearable portion. The holder includes an exterior surface and a magnet. The magnet can couple with the hair-styling tool such that the hair-styling tool is held on the exterior surface of the holder.

In an embodiment, a method of styling hair includes wearing a holder for hair-cutting shears, and coupling hair-cutting shears on an exterior surface of the holder. The hair-cutting shears can be removed from the exterior surface of the holder when needed and replaced on the exterior surface of the holder when the shears are not needed.

In an embodiment, a holster for hair-cutting shears includes a holder having a pocket, an exterior surface, and a shears-holding portion. The shears-holding portion can hold the hair cutting shears on the exterior surface. The holder can couple with a strap, which can be used to wear the holder.

While the invention is described herein by way of example for several embodiments and illustrative drawings, those skilled in the art will recognize that the invention is not limited to the embodiments or drawings described. It should be understood, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF EMBODIMENTS

As used herein, a "ferromagnetic" material includes any material that is attracted to a magnet. Examples of ferromagnetic materials include iron, steel, nickel, and cobalt.

As used herein, a "holster" means any device that can be worn by or on a person and hold an object.

As used herein, "shears" means a cutting device that includes pivotally connected blades. Examples of shears include styling shears, thinning shears, and scissors, As used herein, a "styling tool" means a tool or device that can be used in styling hair. Examples of styling tools include shears, brushes, combs, hair dryer, electric hair clippers, irons, razors, and spray bottles.

As used herein, a "wearable" means an element or portion of an element that can be worn by a person. In some cases, a wearable element is wrapped goes at least partially around a person, such as a belt or shoulder strap. In other cases, a wearable element is attached to the clothing of a person. For example, a wearable element or portion of an element can be attached or affixed to a person's clothing or to accessories worn by a person, such as a clip, hook, or clasp.

Figure 1:
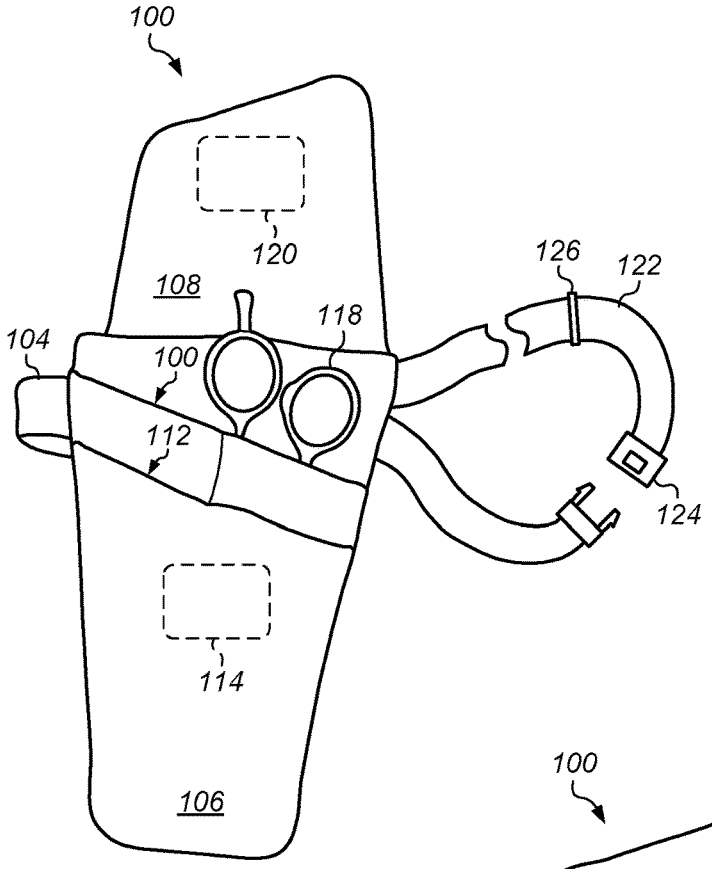
FIG. 1 illustrates one embodiment of a holster for holding hair-cutting shears with the shears in a pocket of a holder.
Figure 2:
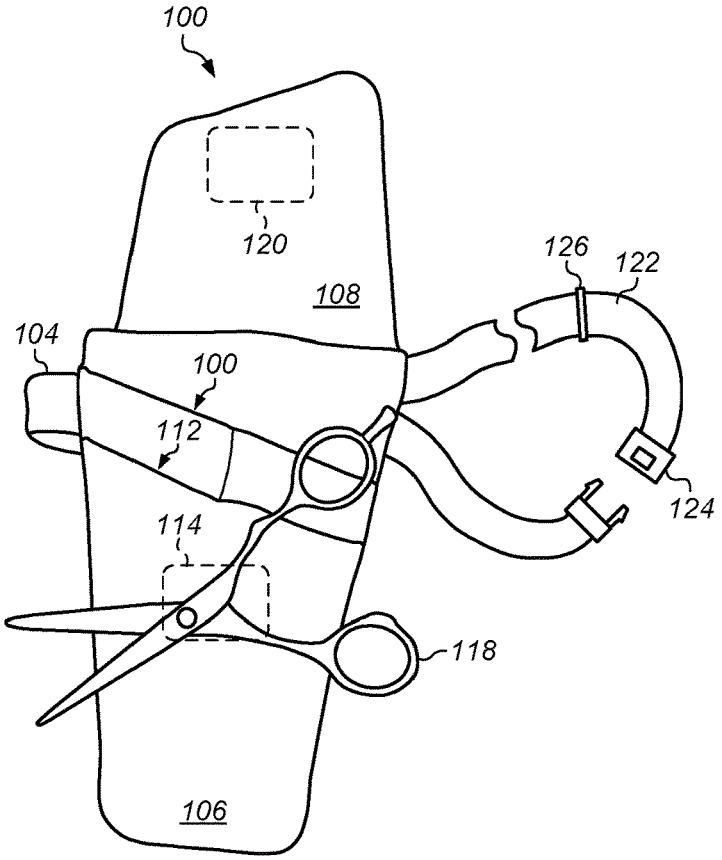
FIG. 2 illustrates one embodiment of a holster for holding hair-cutting shears with the shears attached on an exterior surface of a holder.

FIG. 1 illustrates one embodiment of a holster for holding hair-cutting shears. FIG. 2 illustrates one embodiment of a holster for holding hair-cutting shears with the shears attached on an exterior surface of a holder. Styling tool carrier system 100 includes styling tool holster 102 and strap 104. Styling tool holster 102 includes holder 106 and flap 108. Holder 106 includes inner pocket 110, outer pocket 112, and magnets 114. Magnets 114 are held in outer pocket 112. Holder 106 includes exterior surface 116.

Inner pocket 110 and outer pocket 112 may hold various styling tools, including, for example, shears 118 shown in FIG. 1. Inner pocket 110 and outer pocket 112 are tiered such that the upper edge of outer pocket 112 is below the upper edge of inner pocket 110.

Shears 118 may be made of a ferromagnetic material, such as stainless steel. Shears 118 may be held on exterior surface 116 of holder 106 by magnets 114.

Figure 3:
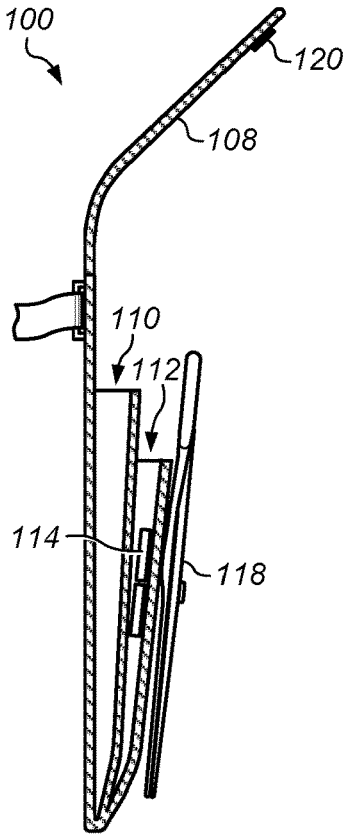
FIG. 3 is a cross-sectional side view illustrating one embodiment of a holster for holding hair-cutting shears with the shears attached on an exterior surface of a holder and a flap in an open position.

FIG. 3 is a cross-sectional side view illustrating one embodiment of a holster for holding hair-cutting shears. Shears 118 are attached on exterior surface 116 of holder 106. Flap 108 is attached to holder 106. Flap 108 can be selectively flipped up or down. Flap 108 may fold forward (for example, in front of inner pocket 110 and outer pocket 112, or backward (for example, behind holder 106). Flap 108 may cover shears 118. Flap 108 may protect shears 118 from damage when not in use. Flap 108 may also keep shears or other tools from contacting persons or other objects when being held in or on styling tool holster 102. For example, flap 108 may cover the pointed end of shears 118 to inhibit shears 118 from puncturing or poking persons or objects while shears 118 are held on styling tool holster 102. In some embodiments, flap 108 covers a pair of shears held in inner pocket 110 or outer pocket 112.

Figure 4:
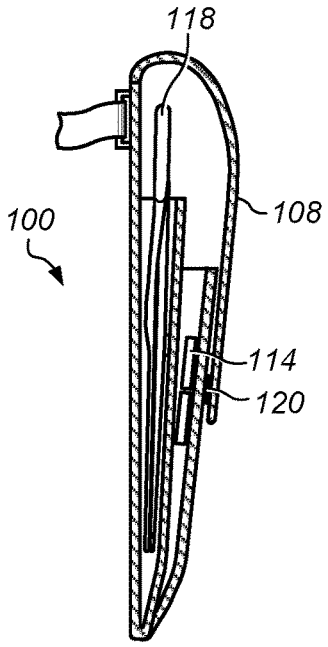
FIG. 4 illustrates one embodiment of a cross-sectional side view of a holster for holding hair-cutting shears with the shears in a pocket of a holder and a flap in a closed position.

FIG. 4 illustrates one embodiment of a cross-sectional side view of a holster for holding hair-cutting shears with the shears held in a pocket of a holder. Flap 108 includes flap latch element 120. Flap latch element 120 may be a ferromagnetic material, such as steel. When flap latch element 120 comes in proximity with one of magnets 114, flap 108 may be held in place against the front of holder 106.

In certain embodiments, the ferromagnetic element and magnet may be reversed from the arrangement shown in FIGS. 3 and 4. In such case, the flap may include a magnet that couples with a ferromagnetic element in a holder.

Styling tool holster 102 and strap 104 may be made of any suitable material. Examples of materials for a styling tool holster and strap include leather, cloth, or a polymeric material such as nylon.

Strap 104 may be used by a stylist to wear styling tool carrier system 100. Strap 104 includes belt 122, buckle 124, and adjustment slide 126. In some embodiments, a strap is fed through a mounting loop in a holster (as shown, for example, in FIG. 3). In certain embodiments, a strap is permanently attached to a holster. For example, a strap may be sewn to a holster. Strap 104 may be made of any material, including leather, cloth, or a polymeric material such as nylon.

Although in the embodiment shown in FIG. 1, a holder is shown on a strap, a holder may in various embodiments be worn with other elements or devices. For example, the holder may be worn on a person by way of a belt clip.

Figure 5:
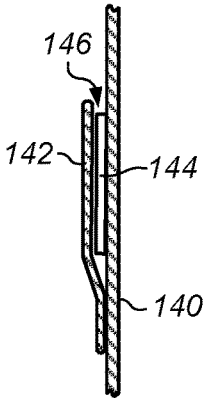
FIG. 5 illustrates one embodiment of a holster with a pouch for a magnet or holding element.

In the embodiment shown in FIG. 1, magnets 114 are held in outer pocket 112 of holder 106. In other embodiments, however, magnets may be held by other elements, such as a clip or strap. FIG. 5 illustrates one embodiment of a holster with a pouch for a magnet or holding element. Holder 140 includes magnet pouch 142. Magnet 144 may be inserted and removed through opening 146 in magnet pouch 142.

Figure 6:
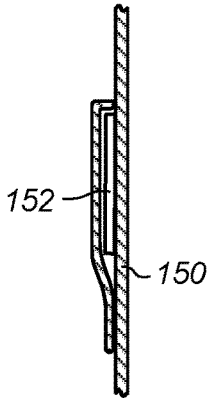
FIG. 6 illustrates one embodiment of a holster with a holding element sewn into a holder.

In some embodiments, a magnet or other holding element is sewn into a holster. FIG. 6 illustrates one embodiment of a holster having a sewn-in magnet for holding styling tools. Holster 150 carries magnet 152. Magnet 152 may be sandwiched between, and sewn into, layers of holster 150.

Figure 7:
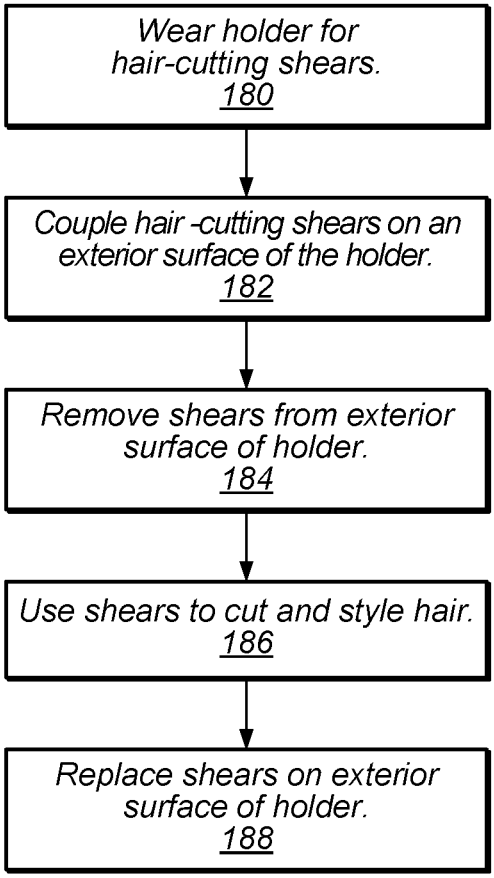
FIG. 7 illustrates styling hair using shears held on an exterior surface of a holster.

FIG. 7 illustrates one embodiment of a method of styling hair with a shears holster. At 180, a holder for hair-cutting shears is worn by a user, such as a hair stylist. The holder may be worn by the person with a shoulder strap, belt, clip, or in any other manner.

At 182, hair-cutting shears are coupled on an exterior surface of the holder. The holder may be, for example, a magnetic holder such as described above relative to FIGS. 1-4.

At 184, hair-cutting shears are removed from the exterior surface of the holder. The stylist may use the shears for cutting and styling hair at 186. After use, the stylist may replace the shears on the holder at 188. The shears may be removed and replaced as needed over the course of a style. In between uses, the stylist may use other tools. In certain embodiments, some of the other tools may be held in the same holder with the shears.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Methods may be implemented manually, in software, in hardware, or a combination thereof. The order of any method may be changed, and various elements may be added, reordered, combined, omitted, modified, etc. Changes may be made in the elements described herein without departing from the spirit and scope of the invention as described in the following claims.

What is claimed is:

1. A system, comprising:

a pair of hair-cutting shears comprising magnetic material; and a holder for holding the pair of hair-cutting shears, the holder comprising:

a holder portion, wherein the holder portion comprises an inner pocket and an outer pocket, an opening of the outer pocket being positioned below an opening of the inner pocket, wherein the inner pocket and the outer pocket are sized to hold the pair of hair-cutting shears with at least part of the pair of hair-cutting shears exposed outside the opening of the respective pocket, and wherein the holder portion comprises a tapered body shape that tapers from a wider width at a top of the holder portion at the opening of the inner pocket to a smaller width at a bottom of the holder portion; and a magnet attached to an outer part of the outer pocket, the magnet being configured to hold the pair of hair-cutting shears in place when the pair of hair-cutting shears are coupled to the magnet; and a flap attached to the top of the holder portion, wherein the flap is configured to flip up and down with the flap covering the inner pocket and the outer pocket when flipped down, the flap comprising a magnetic material in a portion of the flap, wherein the magnetic material in the flap is configured to couple to the magnet when the flap is flipped down, the magnet holding the flap in the flipped down position; and a strap coupled to the holder, the strap being configured to be worn on a person.

2. The system of claim 1, wherein the strap is removable from the holder.

3. The system of claim 1, wherein the strap comprises a buckle.

4. The system of claim 1, where the magnetic material in the flap comprises ferromagnetic material.

5. The system of claim 1, wherein the pair of hair-cutting shears comprise ferromagnetic material.

6. The system of claim 1, wherein the flap, in the flipped down position, is configured to cover the pair of hair-cutting shears when the pair of hair-cutting shears are placed in the inner pocket or the outer pocket.

7. The system of claim 1, wherein the magnet is positioned in a pouch attached to the outer part of the outer pocket.

8. The system of claim 1, wherein the magnet is sewn into the outer part of the outer pocket.

9. The system of claim 1, wherein the holder portion is configured to hold one or more styling tools.

10. The system of claim 1, wherein the holder portion is configured to hold one or more styling tools in addition to the pair of hair-cutting shears.

* * * * *